US008327562B2

(12) United States Patent
Hartwick et al.

(10) Patent No.: US 8,327,562 B2
(45) Date of Patent: Dec. 11, 2012

(54) HYDRAULIC SYSTEM WITH THERMAL SHOCK PROTECTION

(75) Inventors: Ty Hartwick, Pella, IA (US); Jason Morgan, Pleasantville, IA (US)

(73) Assignee: Vermeer Manufacturing Company, Pella, IA (US)

( * ) Notice: Subject to any disclaimer, the term of this patent is extended or adjusted under 35 U.S.C. 154(b) by 1141 days.

(21) Appl. No.: 12/215,692

(22) Filed: Jun. 26, 2008

(65) Prior Publication Data

US 2009/0007462 A1 Jan. 8, 2009

Related U.S. Application Data

(60) Provisional application No. 60/937,671, filed on Jun. 29, 2007.

(51) Int. Cl.
*E02F 5/02* (2006.01)

(52) U.S. Cl. ..... 37/348; 37/382; 37/414; 60/329; 137/468

(58) Field of Classification Search ..... 37/348, 37/382, 413, 414; 91/419; 137/468; 60/329, 60/456, 484, 486; 92/1
See application file for complete search history.

(56) References Cited

U.S. PATENT DOCUMENTS

| | | | | |
|---|---|---|---|---|
| 3,089,306 | A * | 5/1963 | Fitchie | 60/39.091 |
| 3,401,605 | A * | 9/1968 | Born | 91/419 |
| 3,895,490 | A | 7/1975 | Pachins | |
| 3,969,897 | A | 7/1976 | Humphreys et al. | |
| 4,083,469 | A * | 4/1978 | Schexnayder | 414/509 |
| 4,126,993 | A * | 11/1978 | Grattapaglia et al. | 60/329 |
| 5,564,274 | A * | 10/1996 | Denbraber et al. | 60/329 |
| 5,887,365 | A * | 3/1999 | Fujishima et al. | 37/348 |
| 6,467,201 | B1 * | 10/2002 | McSharry et al. | 37/347 |
| 7,665,930 | B2 * | 2/2010 | Kennedy et al. | 405/144 |
| 2005/0150143 | A1 * | 7/2005 | Charles | 37/414 |
| 2005/0183417 | A1 | 8/2005 | Nakagawa et al. | |

FOREIGN PATENT DOCUMENTS

| | | |
|---|---|---|
| DE | 44 39 454 A1 | 5/1996 |
| JP | 62-118107 | 5/1987 |
| JP | 2002-276618 | 9/2002 |
| JP | 2003-184827 | 7/2003 |
| JP | 2005-24098 | 1/2005 |
| SU | 1159991 A | 6/1985 |
| WO | WO 99/43931 | 9/1999 |

OTHER PUBLICATIONS

International Search Report and Written Opinion mailed Oct. 1, 2008.

* cited by examiner

*Primary Examiner* — Jamie L McGowan

(74) *Attorney, Agent, or Firm* — Merchant & Gould P.C.

(57) ABSTRACT

A hydraulic system with thermal shock protection. The hydraulic system can include a controller that limits when hot hydraulic fluids may be directed to cold hydraulic components. The hydraulic system can be used in machines such as trenchers to protect hydraulic components such as hydraulic motors from failure due to thermal shock.

13 Claims, 5 Drawing Sheets

HYDRAULIC SYSTEM WITH THERMAL SHOCK PROTECTION

RELATED APPLICATIONS

This application claims priority to provisional application Ser. No. 60/937,671 titled Hydraulic System With Thermal Shock Protection filed on Jun. 29, 2007, which is incorporated by reference in its entirety herein.

TECHNICAL FIELD

The present disclosure relates to a hydraulic system with thermal shock protection, more particularly, to a hydraulic system that is configured to protect hydraulic motor components when the components are used in cold weather.

BACKGROUND

Hydraulic components can fail or prematurely wear as a result of thermal shock. In the context of a hydraulic system, thermal shock occurs when hot hydraulic fluids are directed to cold hydraulic components. The rapid localized heating of the cold components can cause individual subcomponents of the hydraulic system to expand at different rates and undesirably contact each other.

A known method of preventing machine failure due to thermal shock is to gradually warm the components of a hydraulic system by manually directing hydraulic fluid through the entire system even before activating the cold components. This method avoids hot fluid being delivered to cold moving components. The effectiveness of this method is limited by the machine operator's ability to recognize the conditions that may cause thermal shock, and to remember to warm up the various hydraulic components before using them. There is a need in the art for improved, and more reliable, methods and systems for preventing machine failure due to thermal shock.

SUMMARY

The present disclosure relates to a hydraulic system with thermal shock protection. The hydraulic system includes a controller that limits when hot hydraulic fluids may be directed to cold hydraulic components.

The present disclosure also relates to a trencher having thermal shock protection system. The trencher includes a control system that protects the hydraulic motor and other hydraulic components from failing as a result of uneven thermal expansion of the subcomponents (e.g., pistons and cylinders) within the hydraulic components (e.g., hydraulic motors).

DETAILED DESCRIPTION

The principles of the present disclosure are applicable to a wide variety of hydraulic systems. However, to provide an exemplary environment in which the various aspects of the present disclosure can be applied, the principles of the present disclosure are described herein with reference to a trencher. Wherever possible, the same reference numbers will be used throughout the drawings to refer to the same or like parts.

Figure 1:
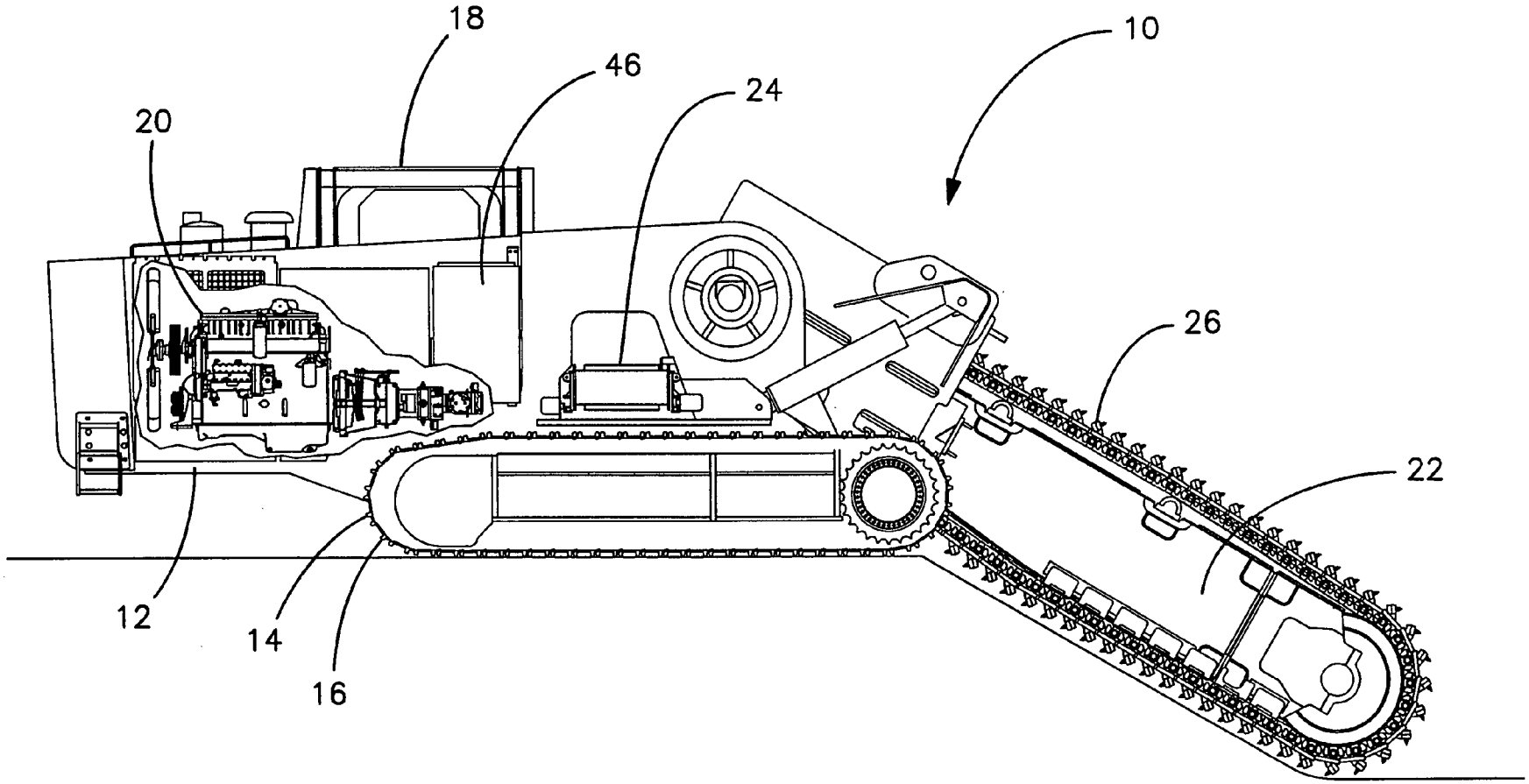
FIG. 1 is a side view of a trencher that embodies principles of the present disclosure.
Figure 2:
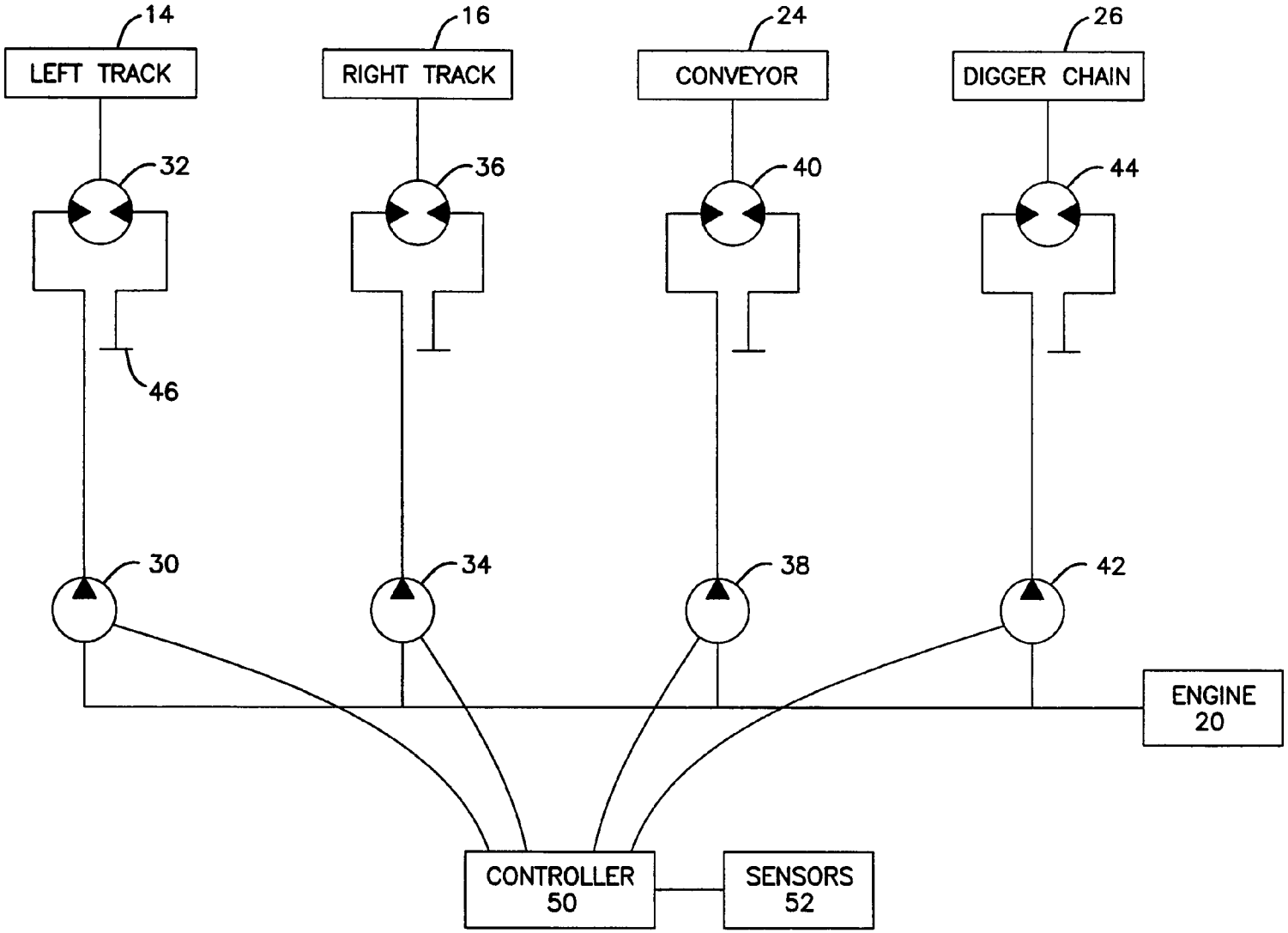
FIG. 2 is a simplified schematic view of a hydraulic circuit of the trencher of FIG. 1 for illustrative purposes.

Referring generally to FIGS. 1 and 2, an exemplary trencher 10 illustrated. The trencher 10 is an example of a machine where at least some of the drive functions are not directly connected to the engine 20 via gears and shafts. The trencher 10 includes a hydraulic system for driving at least some of the drive functions. In particular, the trencher 10 includes an engine 20 that drives a number of hydraulic pumps 30, 34, 38, 42 (shown in FIG. 2) which in turn drive a number of hydraulic motors 32, 36, 40, 44 (shown in FIG. 2) that drive the trencher 10 outputs (e.g., tracks, boom, conveyer, etc.).

More particularly, the depicted trencher 10 includes a chassis 12 that is supported by a pair of tracks 14, 16 that rotate to move the trencher 10. The chassis 12 supports a cab 18, a boom 22, and a conveyer 24. In the depicted embodiment, the cab 18 is configured to move vertically (up and down) with respect to the chassis 12 to provide an operator a clear view of the job site during the trenching. The boom 22 is pivotally coupled to a first end of the chassis 12. The boom 22 is configured to be raised during transport and lowered during the trenching. The boom 22 supports a digger chain 26 that is rotated during trenching operations. The conveyer 24 is used to discharge the dirt, rock, and other debris that are pulled into the trencher 10 out of the side of the trencher 10. In the depicted embodiment, the engine 20 is a diesel powered engine; however, it should be appreciated that any other types of engines/motors are also possible (e.g., gas, electric, hybrid, etc.)

Figure 6:
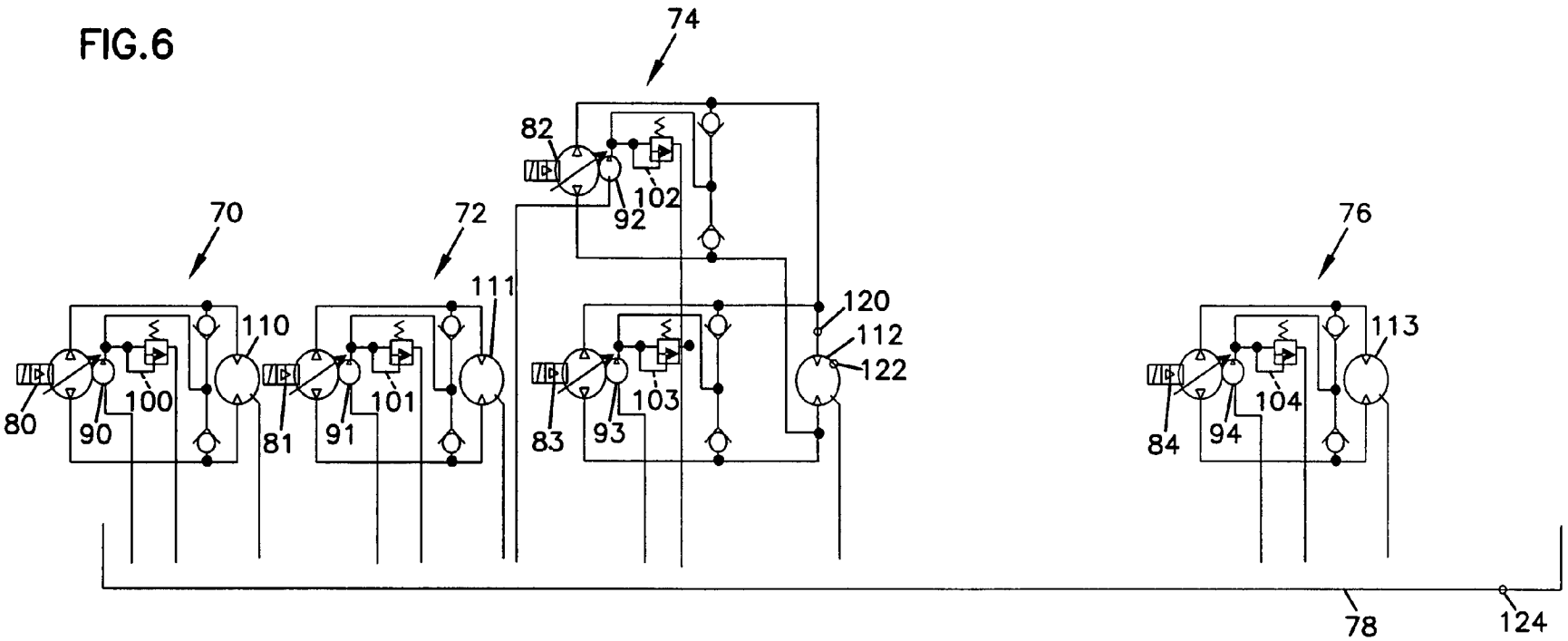
FIG. 6 is a more detailed view of the hydraulic circuit of the trencher of FIG. 1.

Referring to FIG. 2, a simplified hydraulic circuit for a trencher 10 is shown. In the depicted embodiment, the engine 20 drives pumps 30, 34, 38, and 42. Pump 30 provides hydraulic fluid to motor 32, which drives the left track 14 of the trencher 10. Pump 34 provides hydraulic fluid to motor 36, which drives the right track 16 of the trencher 10. Pump 38 provides hydraulic fluid to motor 40, which drives the conveyor 24. Pump 42 provides hydraulic fluid to motor 44, which drives the digger chain 26. In the depicted embodiment the hydraulic fluid in the system share the same reservoir or tank 46. It should be appreciated that the hydraulic configuration shown in FIG. 2 is for illustrative purposes only. An exemplary hydraulic circuit of a trencher 10 is shown in FIG. 6, which is described in detail below.

Since the hydraulic fluid from the various pumps and motor share the same reservoir 46, the depicted hydraulic circuit is configured such that hot hydraulic fluids could potentially be directed to cold hydraulic components. This can occurs when, for example, an operator starts the trencher 10 on a cold day and drives the trencher 10 a distance to the job site. Once reaching the job site, the operator activates the digger chain 26 and begins to trench. In the above scenario, the engine 20 runs pumps 30 and 34 and motors 32 and 36 during transport, but not motor 44. While in transport the temperature of the hydraulic fluid in the reservoir 46 and the hydraulic components that the hydraulic fluid flows through (i.e., pumps 30, 34 and motors 32, 36) gradually increases from the ambient temperature to a normal operating temperature. When the operator arrives at the job site and activates the digger chain 26, hydraulic fluid which is at the normal operating temperature flows into hydraulic components (i.e., pump 42 and motor 44) that are still at or near ambient temperature. Failure due to thermal shock is possible under these conditions since relatively hot hydraulic fluid is directed to flow into the relatively cold hydraulic components. In the depicted embodiment the motor 44 is particularly vulnerable to thermal shock as the clearances between moving parts within the motor 44 is small.

Figure 3:
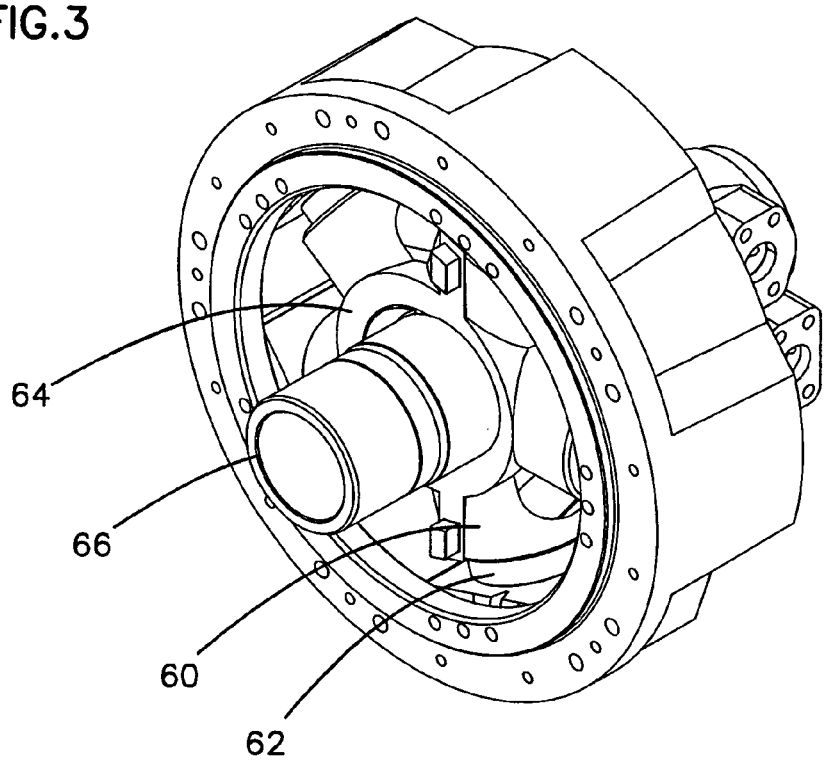
FIG. 3 is a perspective view of the hydraulic motor of FIG. 1.
Figure 4:
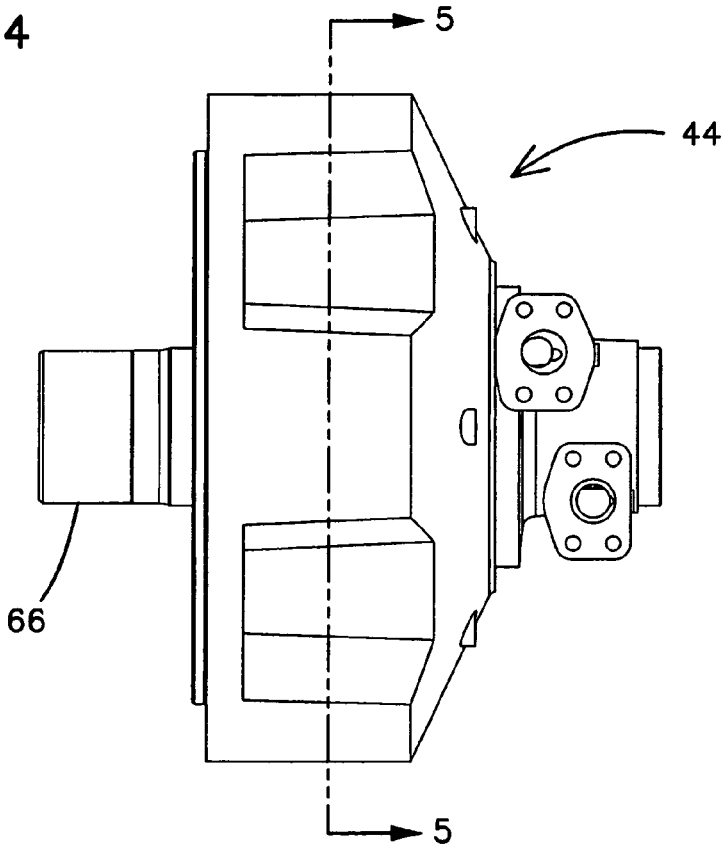
FIG. 4 is a side view of the hydraulic motor of the trencher of FIG. 3.
Figure 5:
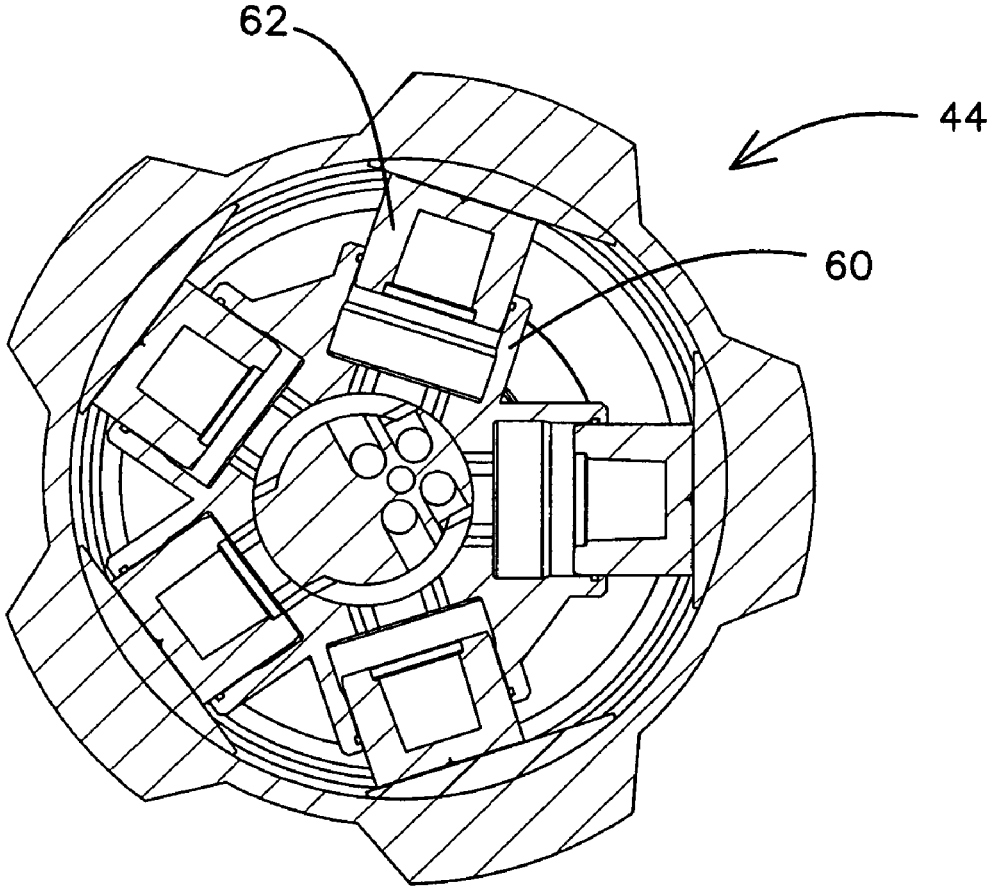
FIG. 5 is a cross-sectional view of the hydraulic motor of FIG. 4 along lines A-A.

Referring to FIGS. 3-5, motor 44 is shown as a large, high efficiency radial piston motor. The major components of the motor 44 include cylinders 60, pistons 62, crankshaft drum 64, and output shaft 66. The force created by the area of the pistons 62 under fluid pressure creates a rotation of the output shaft 66 as the pistons 62 extend in their bore. Two or three pistons 62 are pressurized at the same time to ensure smooth rotational output. Though thermal shock can be an issue in a wide variety of hydraulic components, high efficiency, large hydraulic motors like to the one shown are particularly vulnerable to thermal shock. Since such motors are highly efficient, the clearance between the cylinders 60 and the pistons 62 are relatively small. This relatively small clearance is roughly the same in small and large motors. As compared to a smaller motor, the expansion and contraction of cylinder 60 and piston 62 in a large motor 44 (e.g., 16 liter displacement) is larger as compared to the clearances between the components. In the depicted embodiment the cylinder is approximately four inches in diameter. The combination of high tolerance (i.e., low clearances) and large internal components makes large, high efficiency hydraulic motors particularly susceptible to thermal shock. Since such motors are typically expensive and critical to the operation of the machines, it is desirable that thermal shock is avoided.

Referring back to FIG. 2, a controller 50 and sensors 52 are configured to help avoid failures due to thermal shock. In one embodiment the controller 50 is configured to recognize when thermal shock is possible or likely (i.e., recognize thermal shock conditions) and to automatically respond to prevent damage to the system due to thermal shock.

Recognize Thermal Shock
Condition→Automatically Respond

There are many different ways that the system can be configured to accomplish the above illustrated steps. Some examples are described in greater detail below.

In one embodiment the controller 50 is configured to limit the functionality of the cold components and allow time for the cold components to warm up slowly. In one embodiment the controller 50 is configured to prevent the operator from operating the digger chain 26 if the temperature differential between the hydraulic fluid and the temperature of the motor 44 is greater than a predetermined value. In another embodiment, the controller 50 limits how intensely the operator can use the components to prevent thermal shock. In other words, as the components warm, the operator is allowed to drive the components harder. For example, until the temperature deferential is less than a predetermined valued, the controller 50 does not allow the motor 44 to be operated at speeds above a set RPM. The predetermined value can be in part based on the motor's rating, which is typically provided by the motor manufacturer.

The controller 50 can also be configured to alert the operator when thermal shock conditions exist. In such embodiments, the operator can gradually warm up the cold components by circulating warm hydraulic fluid through components (e.g., digger chain motor 44). This can occur, for example, while the operator drives the trencher 10 to the job site. In other embodiments, the controller 50 is configured to automatically begin circulating hydraulic fluid through the cold components when thermal shock conditions are identified. In such embodiments the machine (e.g., the trencher 10) can be configured such that hydraulic fluid can circulate through the components (e.g., pump 42 and motor 44) without activating the corresponding accessories (e.g., digger chain 26). For example, in some configurations a clutch is provided between the accessories and the corresponding hydraulic components to enable fluid to flow through the components without activating the accessories. In other embodiments, the hydraulic motors are configured such that a certain amount of hydraulic fluid can flow through them while they are in a neutral position.

In some embodiments thermal shock conditions are identified based on measuring the hydraulic fluid temperature and the temperature of the hydraulic components (e.g., motors 32, 36, 40, 44 and pumps 30, 34, 38, 42), and in other embodiments the thermal shock conditions are determined by other means. In one embodiment where the temperature is measured, temperature sensors can be located in the tank 46 to measure the temperature of the hydraulic fluid, and temperature sensors can be located in, on, or near various other hydraulic components. For example, the temperature of the motor 44 can be approximated by measuring the temperature of the fluid at the outlet side of the motor case (i.e., the temperature of the fluid exiting the motor 44). The controller 50 can be configured to allow the operator to operate the digger chain 26 when the motor 44 is warmed enough such that the temperature differential between the hydraulic fluid exiting the motor 44 and the hydraulic fluid in the reservoir 46 is less than the predetermined value.

In an alternative embodiment temperature thermal shock conditions are determined based on measuring the ambient temperature and collecting data regarding the operational characteristics of the machine. For example, the controller 50 may be configured to recognize that thermal shock conditions are present in motor 44 when the ambient temperature is below a certain predetermined temperature (e.g., 0° F.) and when the tracks have been running for a predetermined time before activating the digger chain. The controller may be configured to recognize thermal shock conditions whenever the ambient temperature is below a certain predetermined temperature and certain components are not used (i.e., cold components) and certain other components are used (i.e., hot components). When such conditions occur there exists a likelihood that hydraulic fluid warmed by the hot components can shock the cold components. This alternative embodiment illustrates that the controller 50 can be configured to identify thermal shock conditions without measuring the temperature of the hydraulic fluid or the temperature of the hydraulic components. In the above-described embodiment, the operational characteristics are used in the identification of thermal shock conditions.

Referring to FIG. 6, a more detail hydraulic circuit is shown. The depicted embodiment includes a left track loop 70, a right track loop 72, an attachment loop 74, and a conveyor loop 76, which all share a common tank 78. Each of the depicted loops 70, 72, 74, and 76 includes a proportional pump 80-84, a charge pump 90-94, a charge relief 100-104, and a motor 110-113. As the motors 110-113 loses oil from the loop, the charge pumps 90-94 replaces the lost oil. It should be appreciated that, more than one motor or pump can be used in any one of the loops. For example, the attachment loop 74 includes two pumps 82 and 83 that together drive one motor 112. The depicted embodiment also includes a number of temperature sensors. For example, the depicted circuit includes a temperature sensor 120 for measuring loop temperature, a temperature sensor 122 for measuring the motor case temperature, and a temperature sensor 124 for measuring tank temperature. The sensors 120, 122, and 124 provide data to the control system to for the purpose of avoiding failures of the circuit due to thermal shock. The above specification, examples, and data provide a complete description of the manufacture and use of the composition of the invention. Many embodiments of the invention can be made without departing from the spirit and scope of the invention.

We claim:

1. A trencher comprising:

a chassis supported on a pair of tracks, the tracks configured to move the trencher;

a boom pivotally mounted to the chassis, the boom configured to support a tool;

an engine mounted to the chassis;

a plurality of hydraulic pumps configured to be driven by the engine;

a hydraulic reservoir connected to the plurality of hydraulic pumps;

a track drive hydraulic circuit having a hydraulic motor for driving the tracks, wherein the track drive hydraulic motor is connected to at least one of the plurality of hydraulic pumps;

a tool drive hydraulic circuit having a hydraulic motor for driving the tool, wherein the tool drive hydraulic motor is connected to at least one of the hydraulic pumps;

a control system that includes a thermal shock avoidance function;

wherein, the control system determines a first and second value where the first value is representative of a temperature of hydraulic fluid in the reservoir, and the second value is representative of a temperature of a first hydraulic circuit desired to be activated, the first hydraulic circuit being one of the track drive hydraulic circuit and the tool drive hydraulic circuit; and wherein, the control system compares the first and second values and activates the thermal shock avoidance function if the comparison indicates that the temperature of the hydraulic fluid in the reservoir is a predetermined amount warmer than hydraulic fluid in the first hydraulic circuit.

2. The trencher of claim 1, wherein the second value that is representative of the temperature of the first hydraulic circuit is determined by an algorithm that utilizes an ambient temperature.

3. The trencher of claim 1, wherein the first value that is representative of the temperature of the hydraulic fluid is a temperature of the hydraulic fluid within the hydraulic reservoir.

4. The trencher of claim 1, wherein the second value that is representative of the temperature of the first hydraulic circuit is a temperature of the hydraulic fluid in a hydraulic line connected to an outlet of the tool drive hydraulic motor.

5. The trencher of claim 1, wherein the thermal shock avoidance function limits a maximum flow of hydraulic fluid that can be directed to the tool drive hydraulic motor.

6. The trencher of claim 1, wherein the thermal shock avoidance function alerts an operator that thermal shock conditions exist.

7. The trencher of claim 1, wherein the thermal shock avoidance function automatically directs hydraulic fluid to the tool drive hydraulic motor.

8. The trencher of claim 1, wherein the first value that is representative of the temperature of the hydraulic fluid in the reservoir is determined by an algorithm that utilizes data that corresponds to the operational characteristics of the trencher.

9. A machine comprising:

a chassis supported on a rotatable drive mechanism, the rotatable drive mechanism configured to move the machine;

a tool movably mounted to the chassis;

an engine mounted to the chassis;

a plurality of hydraulic pumps driven by the engine;

a hydraulic reservoir connected to the plurality of hydraulic pumps;

a drive hydraulic circuit having a hydraulic motor for driving the rotatable drive mechanism, wherein the drive hydraulic motor is connected to at least one of the plurality of hydraulic pumps;

a tool drive hydraulic circuit having a hydraulic motor for driving the tool, wherein the tool drive hydraulic motor is connected to at least one of the plurality of hydraulic pumps;

a control system that includes a thermal shock avoidance function;

wherein, the control system determines a first and second value where the first value is representative of a temperature of hydraulic fluid in the reservoir, and the second value is representative of a temperature of a first hydraulic circuit desired to be activated, the first hydraulic circuit being one of the track drive hydraulic circuit and the tool drive hydraulic circuit; and wherein, the control system compares the first and second values and activates the thermal shock avoidance function if the comparison indicates that the temperature of the hydraulic fluid in the reservoir is a predetermined amount warmer than the hydraulic fluid in the first hydraulic circuit.

10. The machine of claim 9, wherein the first and second values are based, at least in part, on an ambient temperature, the temperature of the hydraulic fluid within the hydraulic reservoir, or a temperature of a hydraulic fluid in a hydraulic line connected to the outlet of the tool drive hydraulic motor.

11. The machine of claim 1, wherein the thermal shock avoidance function limits a maximum flow of hydraulic fluid that can be directed to the tool drive hydraulic motor.

12. The machine of claim 1, wherein the thermal shock avoidance function alerts an operator that thermal shock conditions exist.

13. The machine of claim 9, wherein the thermal shock avoidance function automatically directs hydraulic fluid to the tool drive hydraulic motor.

* * * * *